US006832931B1

(12) United States Patent
Wu

(10) Patent No.: US 6,832,931 B1
(45) Date of Patent: Dec. 21, 2004

(54) ELECTRICAL CABLE ASSEMBLY

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/834,456

(22) Filed: Apr. 28, 2004

(51) Int. Cl.[7] ..... H01R 12/24
(52) U.S. Cl. ..... 439/499; 439/579; 439/701
(58) Field of Search ..... 439/492–499, 439/701, 579, 924.1, 679, 79

(56) References Cited

U.S. PATENT DOCUMENTS 6,129,594 A * 10/2000 Lai ..... 439/701
6,203,335 B1 * 3/2001 Chang ..... 439/79
6,210,204 B1 * 4/2001 Ko et al. ..... 439/404
6,273,753 B1 * 8/2001 Ko ..... 439/579
6,648,676 B1 * 11/2003 Lee ..... 439/499

* cited by examiner

*Primary Examiner*—Hien Vu
(74) *Attorney, Agent, or Firm*—Wei Te Chung

(57) ABSTRACT

An electrical cable assembly (100) comprises an insulative housing (1), a plurality of contacts (2) disposed in the housing, a plurality of wires (3) respectively terminated corresponding contacts, and a spacer (4) attached to the insulated housing. The housing defines an elongated slot (123) therein along a longitudinal direction. The contacts are arranged in two rows on two sides of the slot, and tail portions (214, 236) thereof are exposed outside a rear face (102) of the housing. The spacer has a longitudinal first side (402) and an opposite second side (404), each side defining a plurality of grooves (45, 432). The grooves provided in the first side have three different sizes in the longitudinal direction for receiving a different number of the tail portions therein. Thus the tail portions are solder to the wires in a constrained, supported manner for avoiding mis-soldering and achieving good soldering effect.

10 Claims, 10 Drawing Sheets

ELECTRICAL CABLE ASSEMBLY

CROSS-REFERENCE TO RELATED APPLICATIONS

This application is related to U.S. patent application Ser. No. 10/776,077 filed on Feb. 10, 2004 and entitled "HIGH SPEED ELECTRICAL CABLE ASSEMBLY", U.S. patent application Ser. No. 10/456,369 filed on Jun. 6, 2003 and entitled "HIGH SPEED ELECTRICAL CONNECTOR" and U.S. patent application Ser. No. 10/678,991 filed on Oct. 2, 2003 and entitled "HIGH SPEED ELECTRICAL CONNECTOR", all of which are assigned to the same assignee as the present invention. The disclosure of these related applications is incorporated herein by reference.

BACKGROUND OF THE INVENTION

1. Field of the Invention

The present invention generally relates to an electrical cable assembly, and more particularly to a high speed Serial Attached SCSI (Small Computer System Interface) (SAS) cable assembly.

2. Description of Related Art

Computers are widely used in the fields of E-commerce, E-business, Home network, Internet work station and so on. Each computer has a data storage center, e.g. hard disk, where computer software and business data information are saved. When the computer runs, the computer CPU (Central Processing Unit) continuously accesses the hard disk and retrieves data from the hard disk or stores data to the hard disk. For compatibility, the hard disk drive interfaces are standardized. There are many hard disk drive interface standards and the SCSI (Small Computer System Interface) families and ATA (Advanced Technology Attachment) families are the most famous in the last decade.

Serial Attached SCSI (SAS) is a successor to the parallel SCSI and is based on serial technology. Besides the advantage of higher speed signal transmission, another most significant advantage is that the SAS interface will also be compatible with serial ATA (SATA) drives. The SAS receptacle connector has generally the same configuration as the SATA receptacle connector except that the two cavities of the SATA receptacle connector are merged in a large one, and a third set of signal contacts are assembled to a second side wall opposing a first side wall where two sets of contacts have already being assembled.

Generally, the SAS receptacle connector connects with other electronic equipment via a cable with wires terminated to the contacts thereof. An SAS cable end connector assembly comprises a housing, a plurality of contacts, a plurality of wires, and a cover over molded with the housing and the solder joints of the wires and the contacts. The contacts are disposed in opposite side walls of the housing with tail portions thereof projecting outside a rear end of the housing for soldering to corresponding wires. According to the SAS standard, the contacts comprise three sets of power contacts. Each set of power contacts consists of three power contacts and is adapted to be electrically connected with only one wire. However, it is difficult to correctly solder the specific three sets of miniature contacts and the freely movable wires together in an unsupported or unidentifiable condition. It is prone to solder the wire to an incorrect contact if the three sets of power contacts are not separated from other adjacent contacts. Therefore, it is necessary to provide a spacer to support and separate tail portions of the power contacts into several sets for easy identification during soldering. Further, during the over-molding process of the cover, the melted plastic material tends to seep into contact receiving passageways of the housing from rear end thereof, which will inevitably affect the quality of electrical connection between the cable end connector assembly and a mating connector.

Hence, a cable assembly having an improved spacer is desired to overcome the disadvantages of the related art.

BRIEF SUMMARY OF THE INVENTION

Accordingly, the object of the present invention is to provide a cable assembly having a spacer, which can facilitate identification of particular contacts during soldering to corresponding wires.

In order to achieve the above-mentioned object, an electrical cable assembly in accordance with the present invention comprises an insulative housing, a plurality of contacts disposed in the housing, a plurality of wires respectively terminated to corresponding contacts, and a spacer attached to the insulative housing. The housing defines an elongated slot therein along a longitudinal direction. The contacts are arranged in two rows on two sides of the slot, and the tail portions thereof are exposed outside a rear face of the housing. The spacer has a longitudinal first side and an opposite second side, each side defining a plurality of grooves. The grooves provided in the first side have three different sizes in the longitudinal direction for receiving a different number of the tail portions therein. Thus the tail portions are soldered with the wires in a constrained, supported manner for avoiding mis-soldering and achieving good soldering effect.

Other objects, advantages and novel features of the invention will become more apparent from the following detailed description of the present embodiment when taken in conjunction with the accompanying drawings.

DETAILED DESCRIPTION OF THE INVENTION

Figure 1:
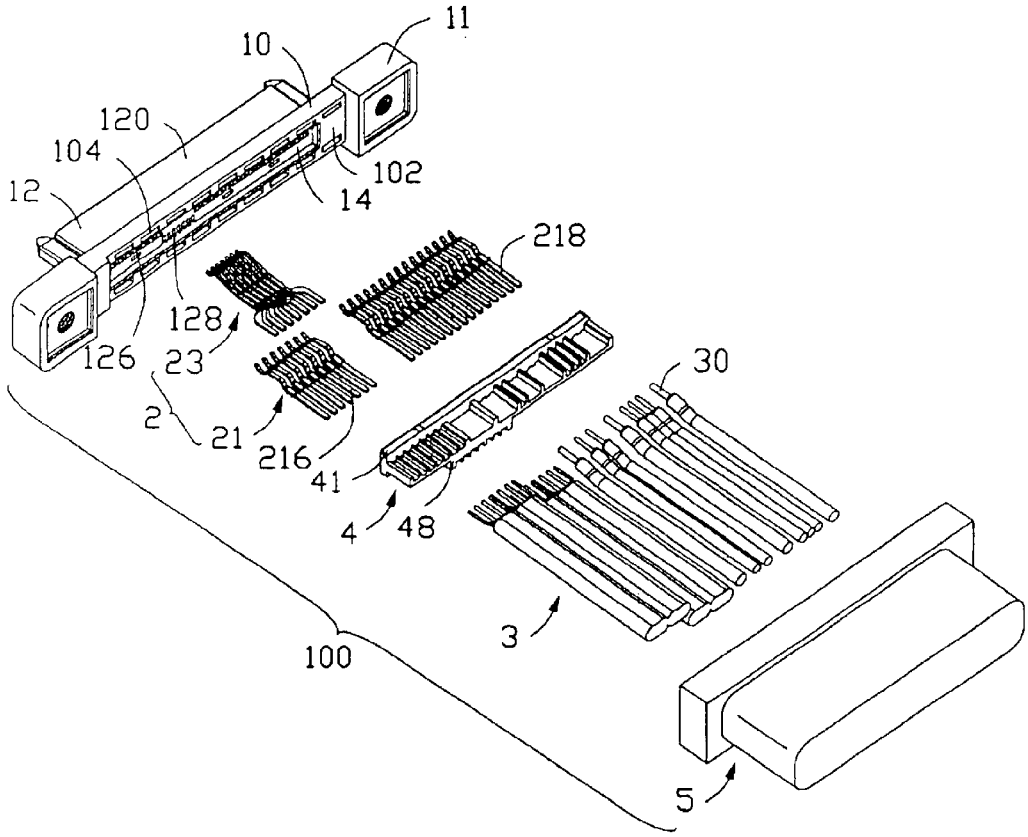
FIG. 1 is an exploded, perspective view of a cable assembly in accordance with the present invention.

Reference will now be made to the drawing figures to describe the present invention in detail.

Figure 2:
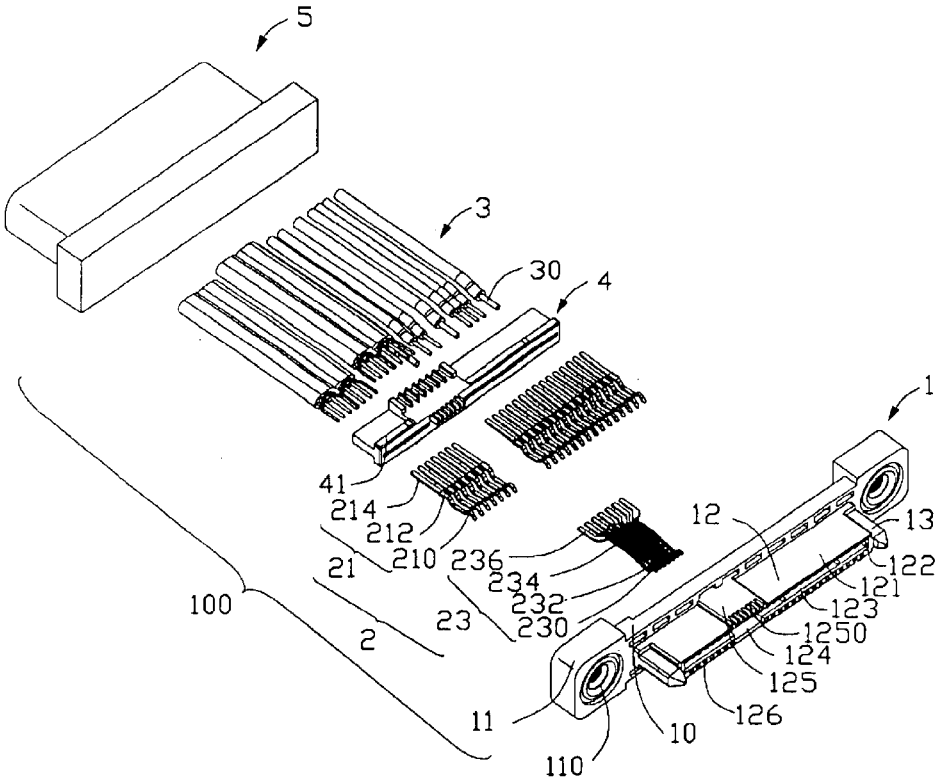
FIG. 2 is a view similar to FIG. 1, but viewed from a different angle.

Referring to FIGS. 1–2 and in conjunction with FIGS. 6–9, an electrical cable assembly 100 in accordance with the present invention comprises an insulative housing 1, a plurality of contacts 2 received in the housing 1, a plurality of wires 3 electrically terminated to the contacts 2, a spacer 4 attached to the housing, and a cover 5 overmolded with the housing 1, tail portions of the contacts 2 and front portions of the wires 3.

The housing 1 is formed with an elongated base 10, a pair of end portions 11 at opposite two ends of the base 10, and a mating portion 12 extending forwardly from the base 10. Each of the end portions 11 defines a screw hole 110 therethrough. The base 10 defines a plurality of openings 104 arranged in two parallel rows at opposite sides thereof, and a rectangular recess 14 recessed from a rear face 102 thereof and located between the two rows of the openings 104. The mating portion 12 has opposite first and second elongated side walls 120, 121 and a pair of opposite lateral end walls 122 connecting with the first and the second side walls 120, 121, thereby together defining an uninterrupted central slot 123 along a lengthwise direction of the housing 1. A pair of forwardly extending guiding portions 13 respectively connect with exterior faces of the end walls 122. The first side wall 120 defines a channel 124 recessed from an interior face thereof and in communication with the central slot 123 in a transverse direction. The second side wall 121 comprises an expanded portion 125 in alignment with the channel 124 in the transverse direction. The channel 124 divides the first side wall 120 into two portions having different dimensions along the longitudinal direction. The thickness of the first side wall 120 is larger than that of the second side wall 121.

The housing 1 defines plural first passageways 126 in the first side wall 120 and plural second passageways 128 in the expanded portion 125 of the second side wall 121. The first and the second passageways 126, 128 extend through the mating portion 12 and the base 10 along a front-to-back direction in communication with the recess 14. The expanded portion 125 further defines plural opened cutouts 1250 extending from a front end thereof along the front-to-back direction and in communication with corresponding second passageways 128.

The contacts 2 comprise a plurality of first contacts 21 and a plurality of second contacts 23. Each first contact 21 comprises a curved contact portion 210, a rearwardly extending tail portion 214, and a retention portion 212 connecting the contact portion 210 and the tail portion 214. Each of the second contacts 23 comprises a contact portion 232, a retention portion 234, a tail portion 236 dependent from the retention portion 234, and an arcuate tip portion 230 extending forwardly from the contact portion 232 and curved in a direction opposite to that of the contact portion 232. The tail portions 236 of the second contacts 23 are laterally and outwardly offset to increase pitch thereof so as to facilitate soldering with corresponding wires 3.

The first contacts 21 comprise a signal segment 216 and a power segment 218. The contacts in the signal segment 216 and the second contacts 23, which are equal in number, are soldered with corresponding conductors 30 in a one-to-one relationship, and respectively comprise two pairs of differential signal contacts and three ground contacts arranged at opposite sides of each pair of the differential signal contacts. The power segment 218 includes three sets of power contacts, and two sets of ground contacts located between the adjacent two sets of power contacts. Each set of power contacts consists of three power contacts, which are together soldered to a conductor 30 of the wire 3. One set of ground contacts is soldered with corresponding conductors 30 of the wires 3 in the one-to-one relationship, and the other set of ground contacts consists of three ground contacts, two of which are soldered to a common conductor 30 and the remaining one is soldered to a corresponding conductor 30.

Figure 3:
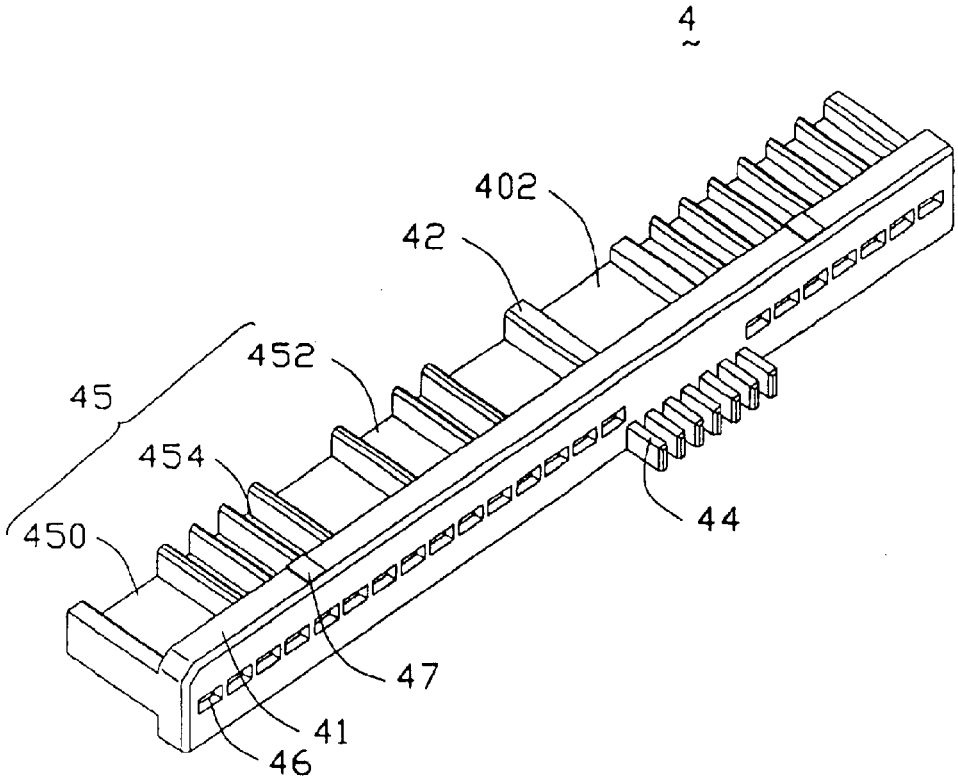
FIG. 3 is an enlarged, perspective view of a spacer shown in FIG. 1.
Figure 4:
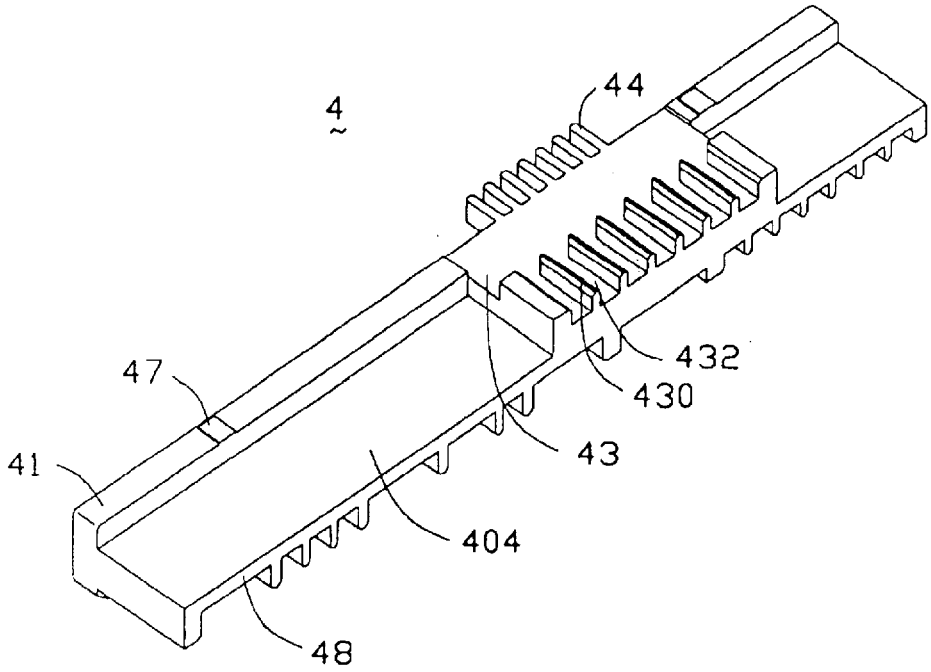
FIG. 4 is a view similar to FIG. 3, but viewed from a different angle.

Particularly referring to FIG. 3 and FIG. 4, the spacer 4 is elongated and comprises a first side 402 formed with a plurality of first partitions 42 thereon and a second side 404 opposite to the first side 402. A stop block 41 extending beyond the first side 402 and the second side 404 along a direction perpendicular to the front-to-back direction. The first partitions 42 of the first side 402 extend from a rear face of the stop block 41 to a rear end 48 of the spacer 4 and define a plurality of grooves 45 therebetween. The grooves 45 include three first grooves 450 having the largest size in a lengthwise direction, one second groove 452 having a smaller size than the first groove 450, and a plurality of third grooves 454 having the smallest size, for accommodating the arrangement of the contacts 2 and the wires 3. The second side 404 is formed with a platform 43 having a surface lower than that of the stop block 41. A plurality of second partitions 430 are formed on the platform 43 and have a dimension smaller than that of the first partitions 42 in the front-to-back direction. Every two adjacent second partitions 430 define a groove 432 therebetween. The stop block 41 is further formed with a plurality of through holes 46 at the locations corresponding to those of the first passageways 126 in the housing 1, and a pair of protrusions 47 on each of two sides thereof. Each of the first grooves 450 is in communication with three through holes 46, the second groove 452 is in communication with two through holes 46, and each of the third grooves 454 is in communication with only one through hole 46. The spacer 4 further comprises a plurality of positioning ribs 44 extending forwardly from a front face thereof at the locations corresponding to those of the third grooves 128 of the housing 1.

The wires 3 comprise a plurality of individual conductors 30 for respectively soldering to corresponding tail portions 214, 236 of the contacts 2.

Figure 5:
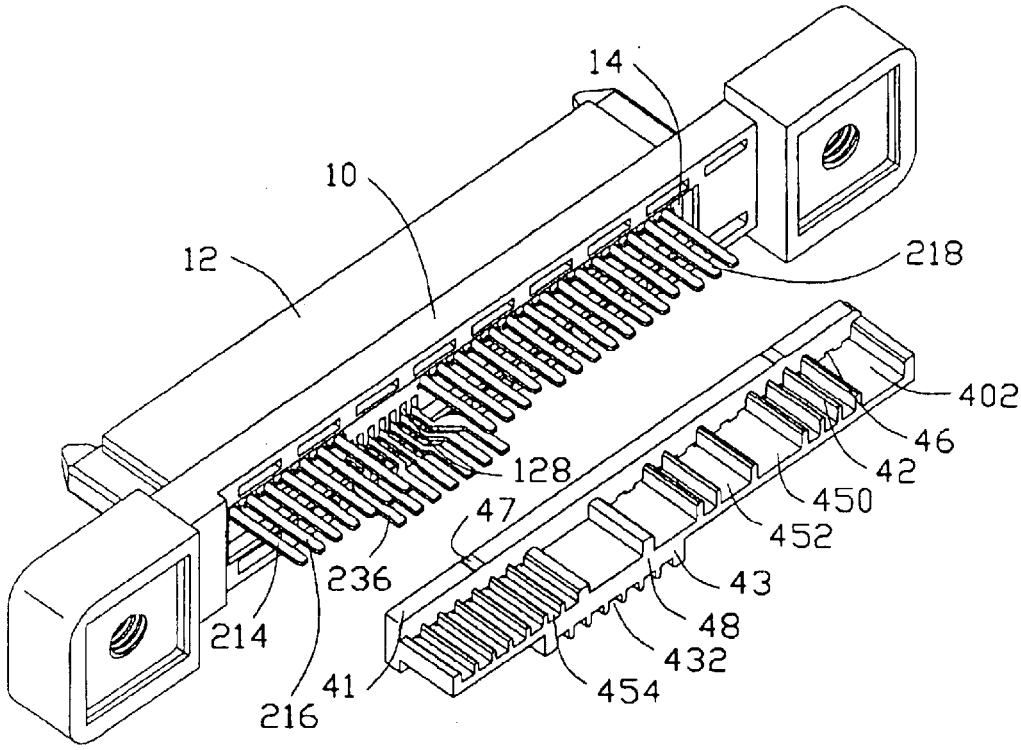
FIG. 5 is a view of a housing with a plurality of contacts assembled thereon and the spacer of the cable assembly shown in FIG. 1.
Figure 6:
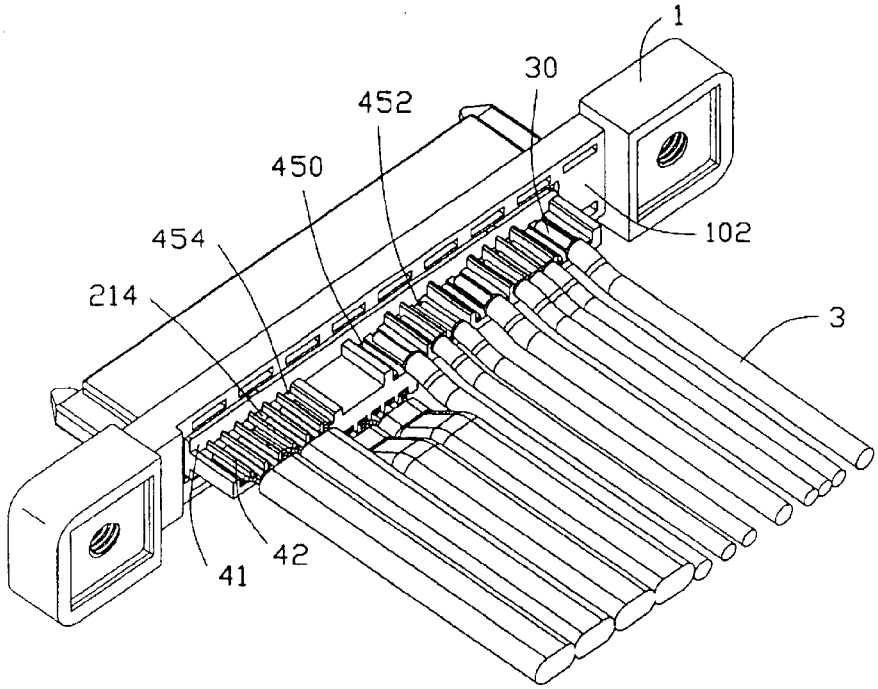
FIG. 6 is a partially assembled view of FIG. 1 without showing an over-molded cover thereof.
Figure 7:
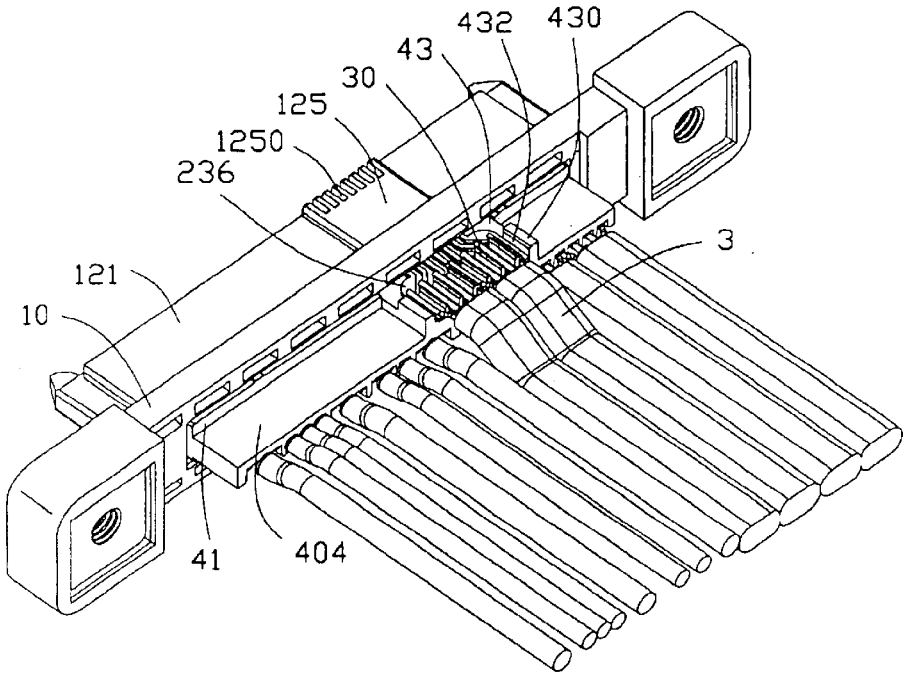
FIG. 7 is a view similar to FIG. 6, but viewed from a different angle.
Figure 10:
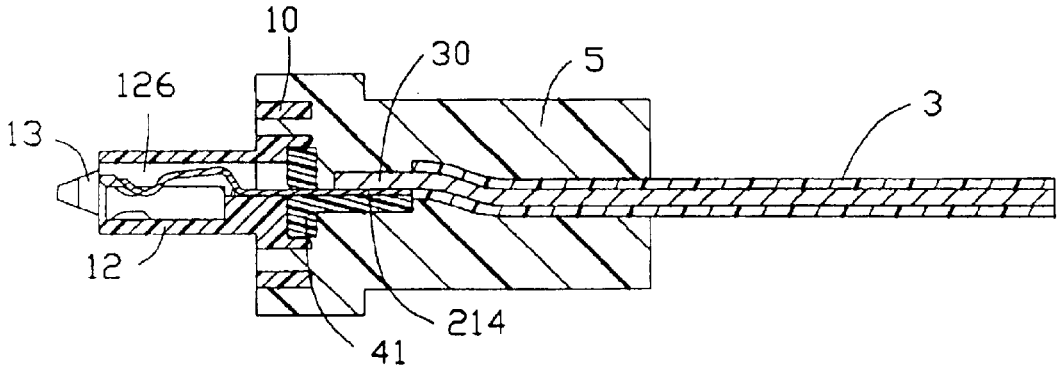
FIG. 10 is a cross-sectional view taken along line 10—10 of FIG. 8.

Referring to FIGS. 5–7 and in conjunction with FIG. 10, the first and the second contacts 21, 23 are respectively inserted into the first and the second passageways 126, 128 of the housing 1, with the contact portions 210, 232 thereof exposed in the central slot 123, with the retention portions 212, 234 thereof interferentially engaging with corresponding passageways 126, 128, and with the tail portions 214, 236 thereof outside the rear face 102 of the housing 1. Moreover, the tip portions 230 of the second contacts 23 are respectively exposed in the cutouts 1250 of the expanded portion 125, thereby providing enough space for elastic deformation of the tip portions 230 when the cable assembly 100 is mated with a complementary connector. The spacer 4 is then assembled to the rear end of the housing 1. The positioning ribs 44 are respectively inserted into the second passageways 128 for interconnecting the spacer 4 in the housing 1 and sealing the second passageways 128. The stop block 41 is fittingly received in the recess 14 with the protrusions 47 thereof interferentially engaging with interior side surfaces of the recess 14. The tail portions 214 of the first contacts 21 respectively pass through the through holes 46 of the spacer 4 and are separated by the first partitions 42. To be depicted in detail, each first groove 450 receives three tail portions 214 of one set of power contacts of the power segment 218, which are together soldered to a conductor 30 of the wire 3. The second groove 452 receives two tail portions 214 of one set of ground contacts of the power segment 218, which are together soldered to a corresponding conductor 30. Tail portions 214 of the retaining ground contacts of the power segment 218 and the contacts of the signal segment 216 are respectively received in the third grooves 454 and respectively soldered with corresponding conductors 30. The tail portions 236 of the second contacts 23 are directly placed on the platform 43 and are separated from each other by the second partitions 430. The wires 3 are soldered to the contacts 2 with conductors 30 thereof respectively disposed on corresponding tail portions 214, 236 of the contacts 2. The three sets of power contacts and one set of ground contacts of the first contacts 21 are separated from adjacent contacts 21, so the possibility of mis-soldering is eliminated. Furthermore, since the conductors 30 of the wires 3 and the tail portions 214, 235 of the contacts 2 are simultaneously supported by the spacer 4, reliability of the solder connection is greatly improved and alignment for the soldering process is facilitated.

Figure 8:
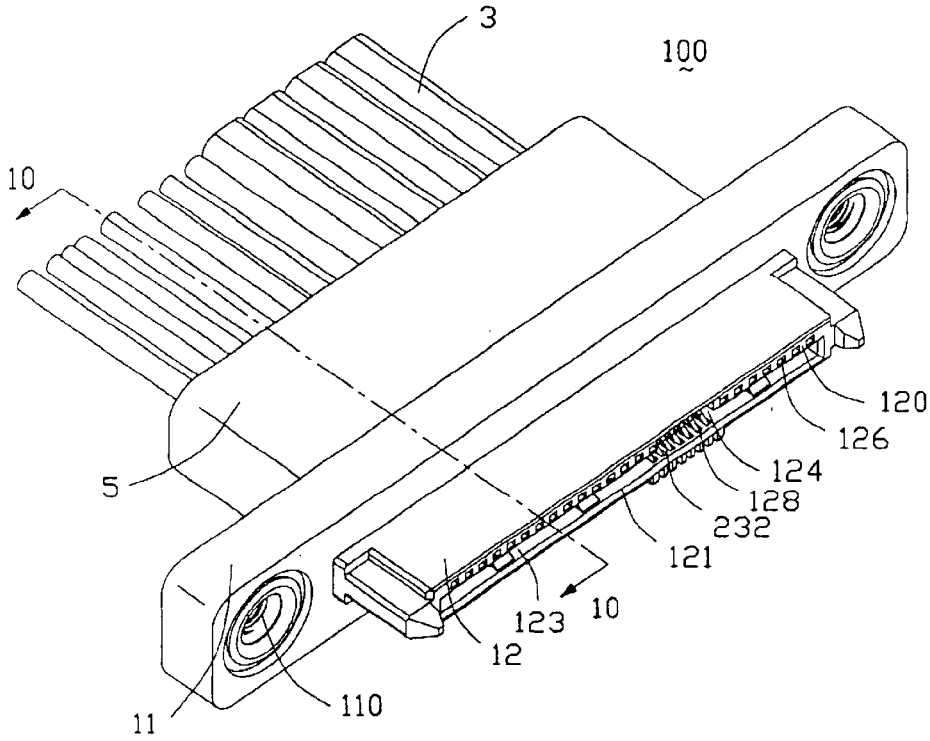
FIG. 8 is an assembled view of the cable assembly shown in FIG. 1.
Figure 9:
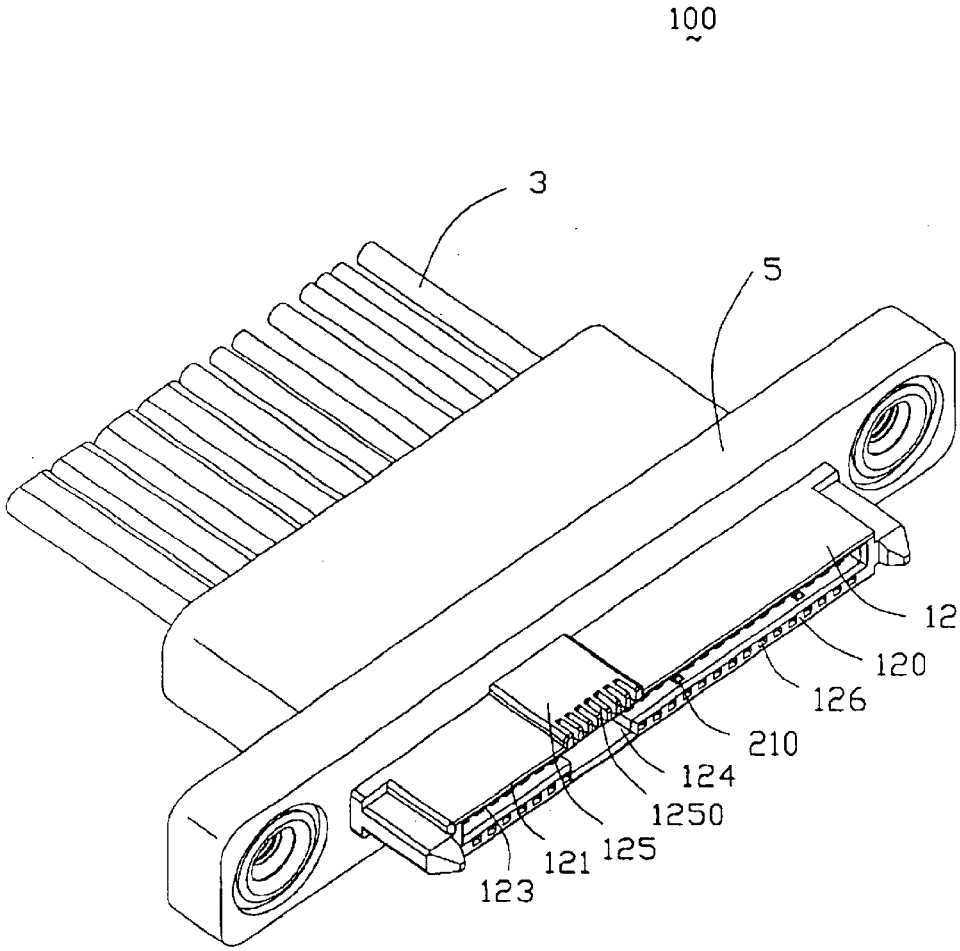
FIG. 9 is a view similar to FIG. 8, but viewed from a different angle.

Referring to FIGS. 8–10, an additional insulative cover 5 is provided after the housing 1, the contacts 2, the spacer 4 and the wire 3 are assembled together. The cover 5 is molded over the base 10 of the housing 1 and molded over the solder connection between the contacts 2 and the wire 3. During over-molding process, since the positioning ribs 44 and the stop block 41 of the spacer 4 seal the passageways 126, 128 from the rear end of the housing 1, the plastic material used in forming the cover 5 will not overflow and seep into the housing 1. Moreover, due to the constraining and supporting functions of the grooves 45, 432 of the spacer 4, even if the tail portions 214, 236 of the contacts 2 are subjected to the high pressure of the plastic material injected during the molding of the cover 5, the tail portions 214, 236 of the contacts 2 will not displaced. Aside from that, the plastic material will overflow the openings 104 of the housing 1 during molding the cover 5 to prevent the cover 5 from separating from the housing 1 after cooling down.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical cable assembly, comprising:

an insulative housing defining an elongated slot along a longitudinal direction thereof, the housing comprising opposite longitudinal first and second walls located by two sides of the slot, the first wall and the second wall respectively defining a plurality of first passageways and second passageways therein through a rear face of the housing;

a plurality of first contacts and second contacts respectively disposed in corresponding first passageways and second passageways, each of the first and second contacts having a tail portion exposed beyond the rear face of the housing;

a plurality of wires each comprising at least one conductor electrically connecting with a corresponding contact; and a spacer attached to the housing and defining a first side and an opposite second side along the longitudinal direction, the fist side being provided with a plurality of grooves and a plurality of holes in communication with corresponding grooves, the second side being provided with a platform forming a plurality of partitions thereon;

wherein the holes of the spacer are located at positions corresponding to the first passageways, the tail portions of the first contacts pass through corresponding holes to be received and constrained in the grooves, and the tail portions of the second contacts directly extend along the platform and are separated by the partitions;

wherein the housing defines a recess in the rear face in communication with the first and the second passageways, and wherein the spacer comprises a stop block extending beyond the first side and the second side and fittingly in the recess;

wherein the grooves provided in the first side of the spacer have different size in the longitudinal direction.

2. The electrical cable assembly of claim 1, wherein the spacer comprises a plurality of positioning ribs extending forwardly from a front end thereof and respectively received in the second passageways for retaining the spacer to the housing.

3. The electrical cable assembly of claim 1, wherein the second passageways of the housing are offset from the first passageways in a transverse direction.

4. The electrical cable assembly of claim 1, wherein each of the second contacts comprises a contact portion opposite to the tail portion, a retention portion connecting the contact portion and the tail portion, and a curved tip portion extending forwardly from the contact portion, and wherein the second wall of the housing has an expanded portion defining a plurality of opened cutouts in communication with corresponding second passageways and providing enough space for deformation of the tip portions of the second contacts, when the cable assembly is mated with a complementary connector.

5. The electrical cable assembly of claim 4, wherein the housing defines a channel in an interior face of the first wall in alignment with the expanded portion in a transverse direction perpendicular to the longitudinal direction.

6. The electrical cable assembly of claim 4, wherein the tail portions of the second contacts are laterally and outwardly offset to increase pitch thereof so as to facilitate soldering with corresponding wires.

7. The electrical cable assembly of claim 1, wherein the grooves comprise at least one first groove having the largest size for receiving three tail portions of the first contacts, a second groove having a smaller size than the first groove for receiving two tail portions, and a plurality of third grooves having the smallest size each only permitting one tail portion to be received therein.

8. The electrical cable assembly of claim 1, further comprising an insulative cover overmolded on the housing, the tail portions of the contacts and front portions of the wires.

9. An electrical connector assembly comprising:

an insulative housing defining a recess in a rear face thereof and a plurality of passageways extending along a front-to-back direction;

a plurality of contacts inserted into the housing from a rear face thereof, and disposed in the corresponding passageways, respectively, each of said contacts including a tail portion extending rearwardly out of the rear face of the housing;

a spacer comprising a stop block extending beyond sides thereof and fittingly received in said recess, a horizontal plate including a plurality of spaced forward positioning ribs on a front edge thereof and inserted into the corresponding passageways, respectively, for blocking a rear opening of each of said passageways except that the tail portion of each corresponding contact supportably extends rearwardly along and is seated upon the corresponding forward positioning rib, the tail portions of the corresponding contacts further extending rearwardly toward and seated upon the horizontal plate under a condition of being spaced from one another by a plurality of spaced partitions; and a plurality of wires including inner conductors spaced from one another by said partitions and mechanically and electrically connected to the tail portions of the corresponding contacts;

wherein said partitions are integrally formed on said spacer;

wherein said positioning ribs are essentially coplanar with said spacer.

10. The connector assembly as described in claim 9, wherein said tail portion of each of said contacts is fully exposed on one side of the spacer.

* * * * *